US010123106B2

(12) United States Patent
Chiu et al.

(10) Patent No.: US 10,123,106 B2
(45) Date of Patent: Nov. 6, 2018

(54) MULTIFUNCTIONAL HEADPHONE CABLE

(71) Applicant: CONSONANCE TECHNOLOGY CORPORATION, Taipei (TW)

(72) Inventors: Yung-Yi Chiu, Taipei (TW); Kang-Chou Liu, Taipei (TW); Jin-Wen Chan, Taipei (TW)

(73) Assignee: CONSONANCE TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/402,234

(22) Filed: Jan. 10, 2017

(65) Prior Publication Data

US 2018/0199128 A1 Jul. 12, 2018

(51) Int. Cl.
*H04R 1/10* (2006.01)
*G10K 11/178* (2006.01)

(52) U.S. Cl.
CPC ..... *H04R 1/1041* (2013.01); *G10K 11/178* (2013.01); *H04R 1/1025* (2013.01); *H04R 1/1033* (2013.01); *H04R 1/1091* (2013.01); *G10K 2210/3044* (2013.01); *H04R 2420/07* (2013.01); *H04R 2420/09* (2013.01)

(58) Field of Classification Search
CPC .. H04R 1/1033; H04R 1/1025; H04R 1/1066; H04R 1/1083; H04R 1/1091; H04R 2420/07; H04R 2420/09; G10K 2210/1081
See application file for complete search history.

(56) References Cited

U.S. PATENT DOCUMENTS

| | | | | |
|---|---|---|---|---|
| 8,270,655 | B2 * | 9/2012 | Ito | H04R 1/1066 381/309 |
| D735,991 | S * | 8/2015 | Brennan | D3/218 |
| 9,100,744 | B2 * | 8/2015 | Sim | H04R 1/1041 |
| D797,704 | S * | 9/2017 | Fischer | D14/216 |
| 2010/0020998 | A1 * | 1/2010 | Brown | H04R 1/1041 381/380 |
| 2013/0188803 | A1 * | 7/2013 | Shaanan | H04R 5/033 381/74 |
| 2017/0070804 | A1 * | 3/2017 | Lee | H04R 1/1041 |

OTHER PUBLICATIONS

Maxell NC II Noise Cancellation Headphones.*

* cited by examiner

*Primary Examiner* — Duc Nguyen
*Assistant Examiner* — Kile Blair
(74) *Attorney, Agent, or Firm* — Gokalp Bayramoglu

(57) ABSTRACT

A multifunctional headphone cable includes: a connecting line, two ends thereof respectively having an audio connection portion configured with a noise receiving microphone; a controller, configured on the connecting line and including a control circuit, the control circuit being configured with an active noise cancelling (ANC) module in connection with the noise receiving microphone, the control circuit being configured with a hearing amplifier adapted to amplify audio signals, memory module, wireless communication module and wireless charging module; and a power supply unit, configured on the connecting line and in connection with the control circuit.

8 Claims, 17 Drawing Sheets

MULTIFUNCTIONAL HEADPHONE CABLE

TECHNICAL FIELD OF THE INVENTION

The present invention relates to a headphone cable, and more particularly to a multifunctional headphone cable.

DESCRIPTION OF THE PRIOR ART

Current headphone receivers cannot be detached and separated independently from headphone connecting cables for replacement; entire headphones must be discarded if they are damaged, being very wasteful. Furthermore, a listening part internal line is very easy to be pulled apart at the welding point of a receiver and it if pulled with a slight force carelessly, causing headphones to be damaged very easily, and the entire headphone must be discarded once the listening part is damaged without the possibility of the individual replacement of the damaged listening part or listening part connecting line, which is environmentally unfriendly and must be improved.

Furthermore, today's high-grade binaural headphones capable of wireless or wired listening or charging generally need to be installed with a number of more sophisticated electronic elements, batteries and circuits compared with traditional headphones with which a player is connection only through a connecting line; the listening parts thereof are also easy to be pulled damaged and cannot be replaced independently such that the entire headphones must be discarded, which will further result in more global resources waste and merely increase unnecessary recycling processing cost.

SUMMARY OF THE INVENTION

One object of the present invention is to provide a multifunctional headphone cable, enhancing the practicability of a headphone by configuring an active noise cancelling (ANC) module, hearing amplifier, memory module and wireless communication module on a controller thereof.

To achieve the object mentioned above, the present invention proposes a multifunctional headphone cable, including: a connecting line, two ends thereof respectively having an audio connection portion configured with a noise receiving microphone; a controller, configured on the connecting line and including a control circuit, the control circuit being configured with an active noise cancelling (ANC) module in connection with the noise receiving microphone, the control circuit being configured with a hearing amplifier adapted to amplify audio signals, memory module, wireless communication module and wireless charging module; and a power supply unit, configured on the connecting line and in connection with the control circuit.

The present invention has the benefits as following:

1. a general wired headphone can be changed into a wireless active anti-noise headphone through the active noise cancelling (ANC) module.

2. a general wired headphone can be changed into auxiliary hearing, hearing aid equipment through the hearing amplifier and ANC module 22.

3. multimedia files such as music files can be stored in the memory module, and the wireless communication module can synchronize a smart device (e.g. cellular phone) or store multimedia files on a host and memorize playlists through the wireless communication module such as Wi-Fi, 4G, 5G, Bluetooth, RF or NFC, and the present invention can still be used as a player to play music independently while the cellular phone or host is offline.

4. waterproof performance can be enhanced through the configuration of the wireless charging module without needing a charger opening such as USB.

5. the wireless communication module 25 may be of various wireless technologies.

6. the present invention can be in combination with a speaker, wisdom collar, thereby increasing the practicability thereof.

DETAILED DESCRIPTION OF THE PREFERRED EMBODIMENTS

Figure 1:
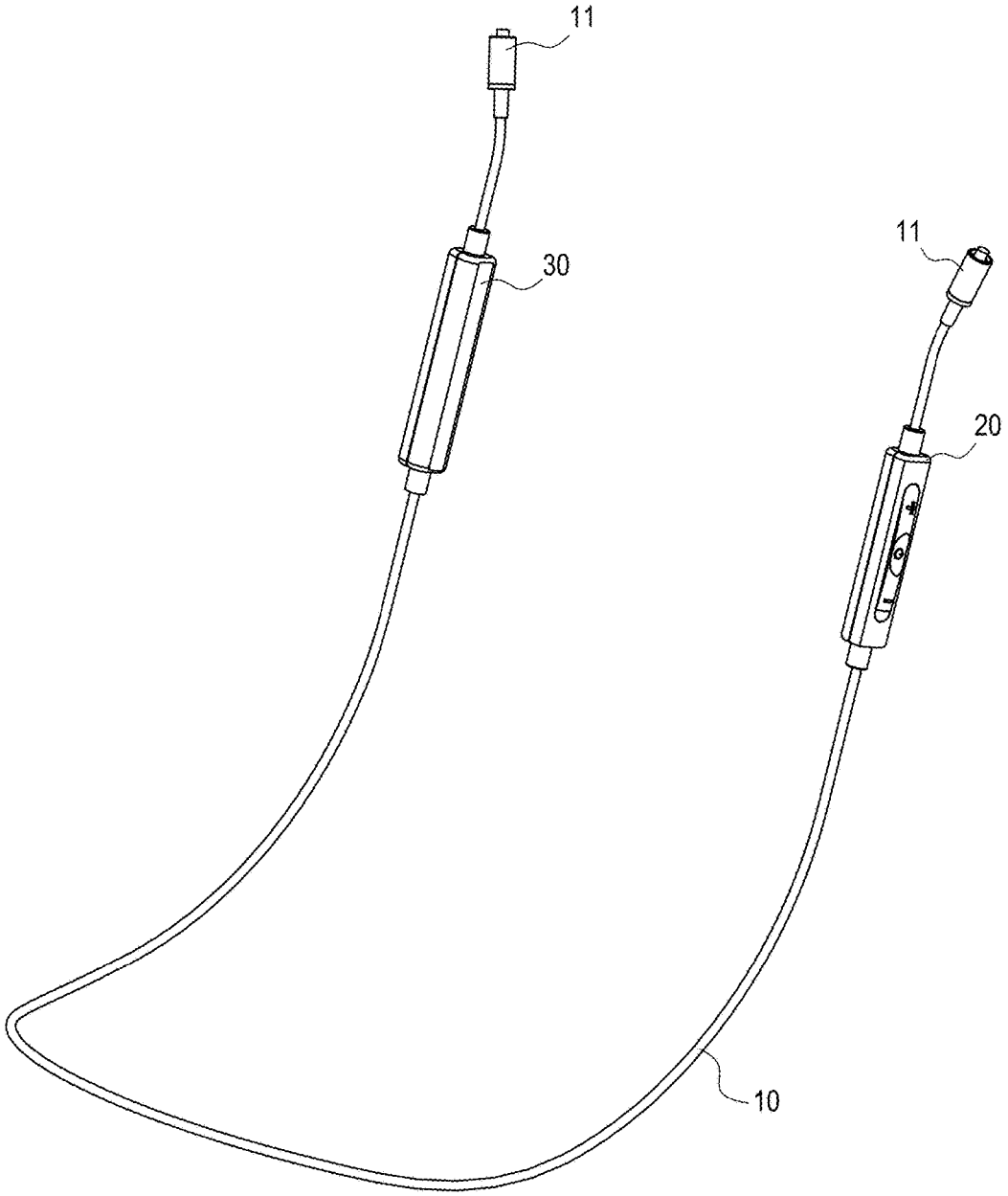
FIG. 1 is a perspective view of the present invention.
Figure 2:
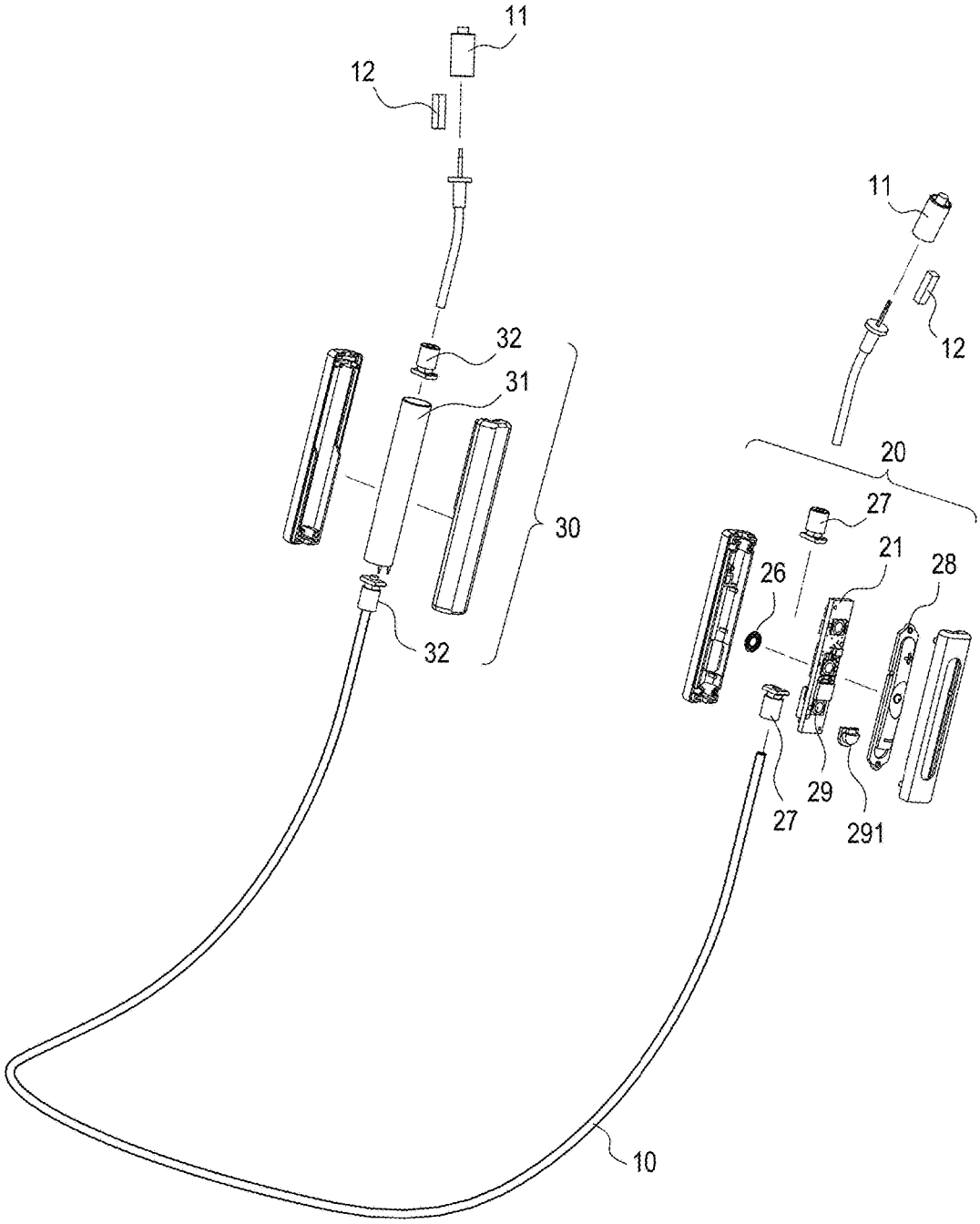
FIG. 2 is an exploded view of the present invention.
Figure 15:
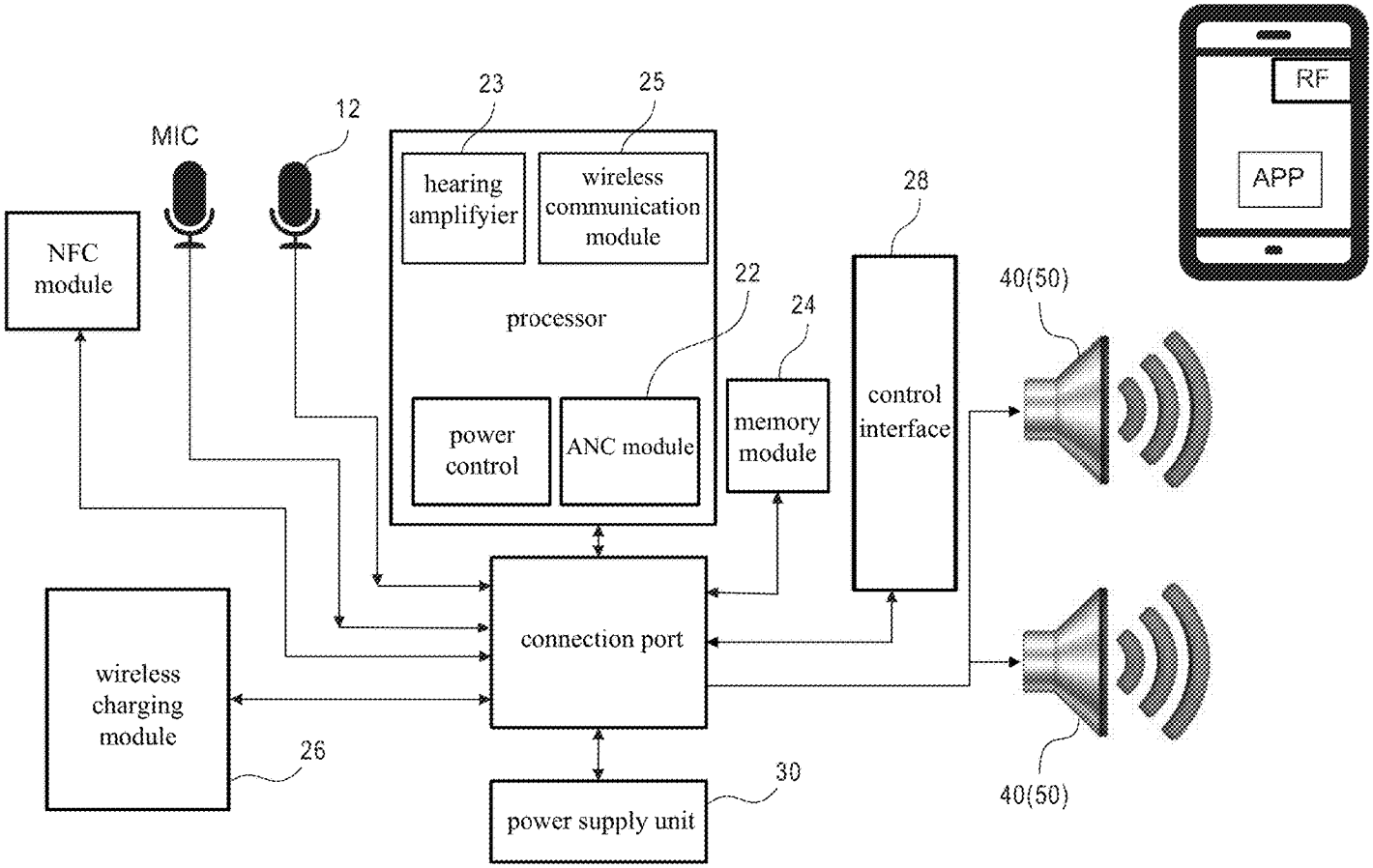
FIG. 15 is a control block diagram of the present invention.
Figure 16:
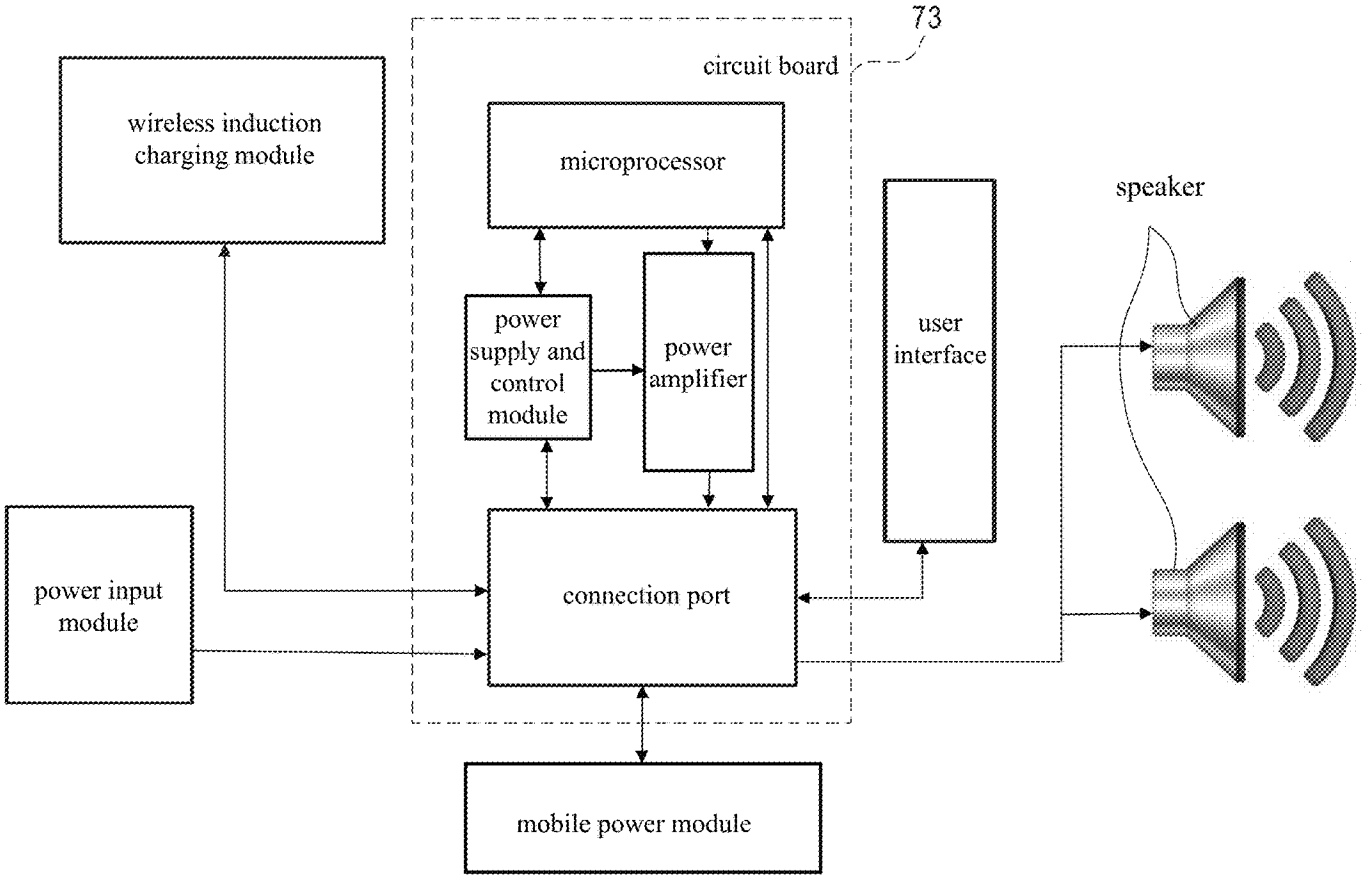
FIG. 16 is a control block diagram of the speaker base of the present invention.
Figure 17:
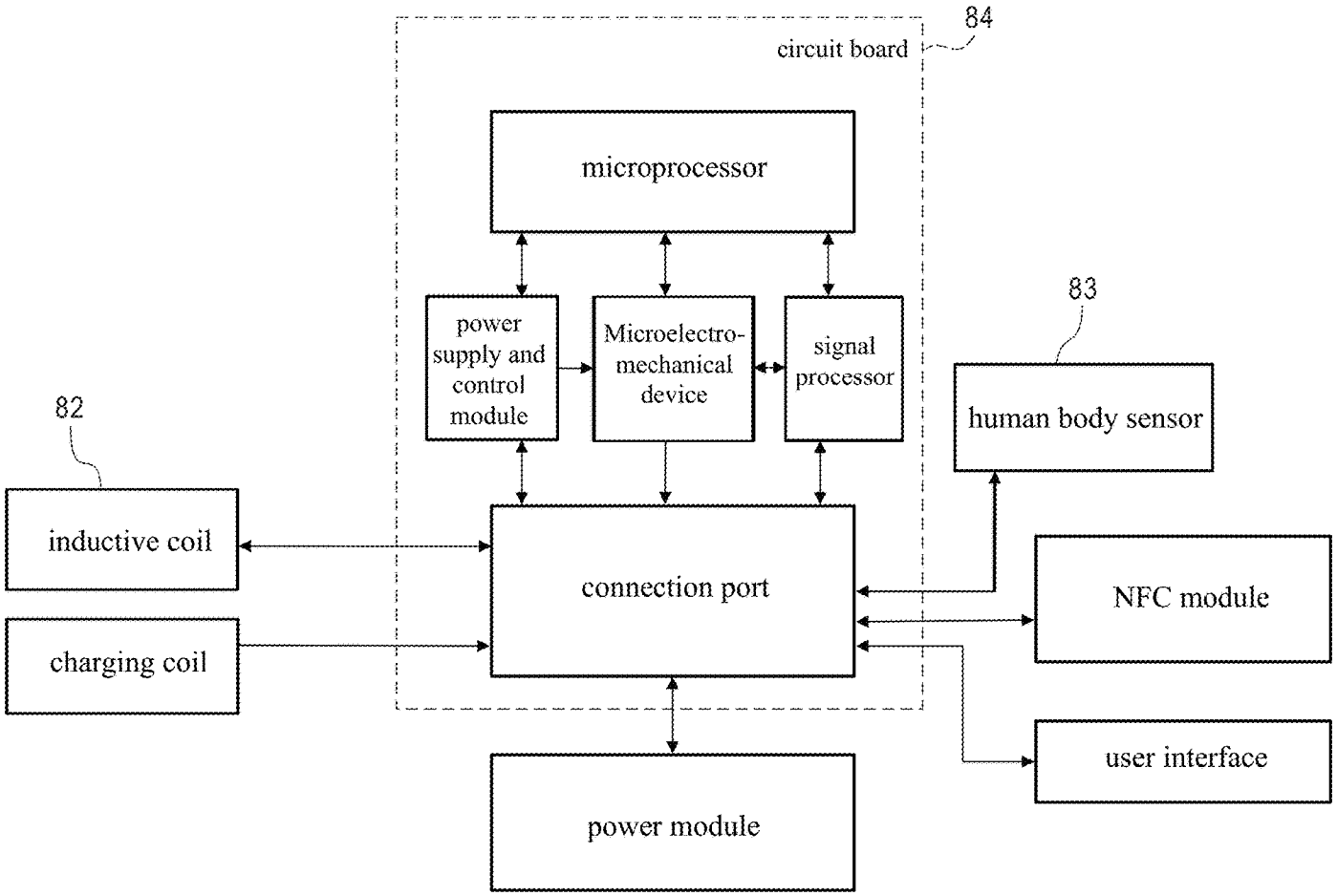
FIG. 17 is a control block diagram of the wisdom collar of the present invention.

Referring to FIGS. 1, 2 and 15, a multifunctional headphone cable of the present invention includes a connecting line 10, a controller 20 and power supply unit 30; they will be described in detail thereinafter.

The two ends of the connecting line 10 respectively have an audio connection portion 11 configured with a noise receiving microphone 12.

The controller 20 is configured on the connecting line 10 and includes a control circuit 21, which is configured with an active noise cancelling (ANC) module 22 in connection with the noise receiving microphone 12, where the control circuit 21 is configured with a hearing amplifier 23 adapted to amplify audio signals, memory module 24, wireless communication module 25, and wireless charging module 26.

The power supply unit 30 is configured on the connecting line 10 and connected to the control circuit 20, and includes a battery 31.

In a preferred embodiment, the two sides of the controller 20 respectively have a shell joint configured with a waterproof body 27, and the two sides of the power supply unit 30 respectively have a shell joint configured with a sealing body 32 used for waterproof seal.

In a preferred embodiment, the controller 20 includes a control interface 28 in connection with the control circuit 21, such as a switching button, the control interface 28 being adapted to control functions.

In a preferred embodiment, the control circuit 21 is configured with a lamp 29, on the outside of which a lampshade 291 is configured, adapted to emit light to display functional operations and states.

In a preferred embodiment, the wireless communication module 25 may be Wi-Fi, 4G, 5G, Bluetooth, radio frequency (RF) or near field communication (NFC).

In a preferred embodiment, the wireless charging module 26 may be a wireless charging coil.

Figure 3:
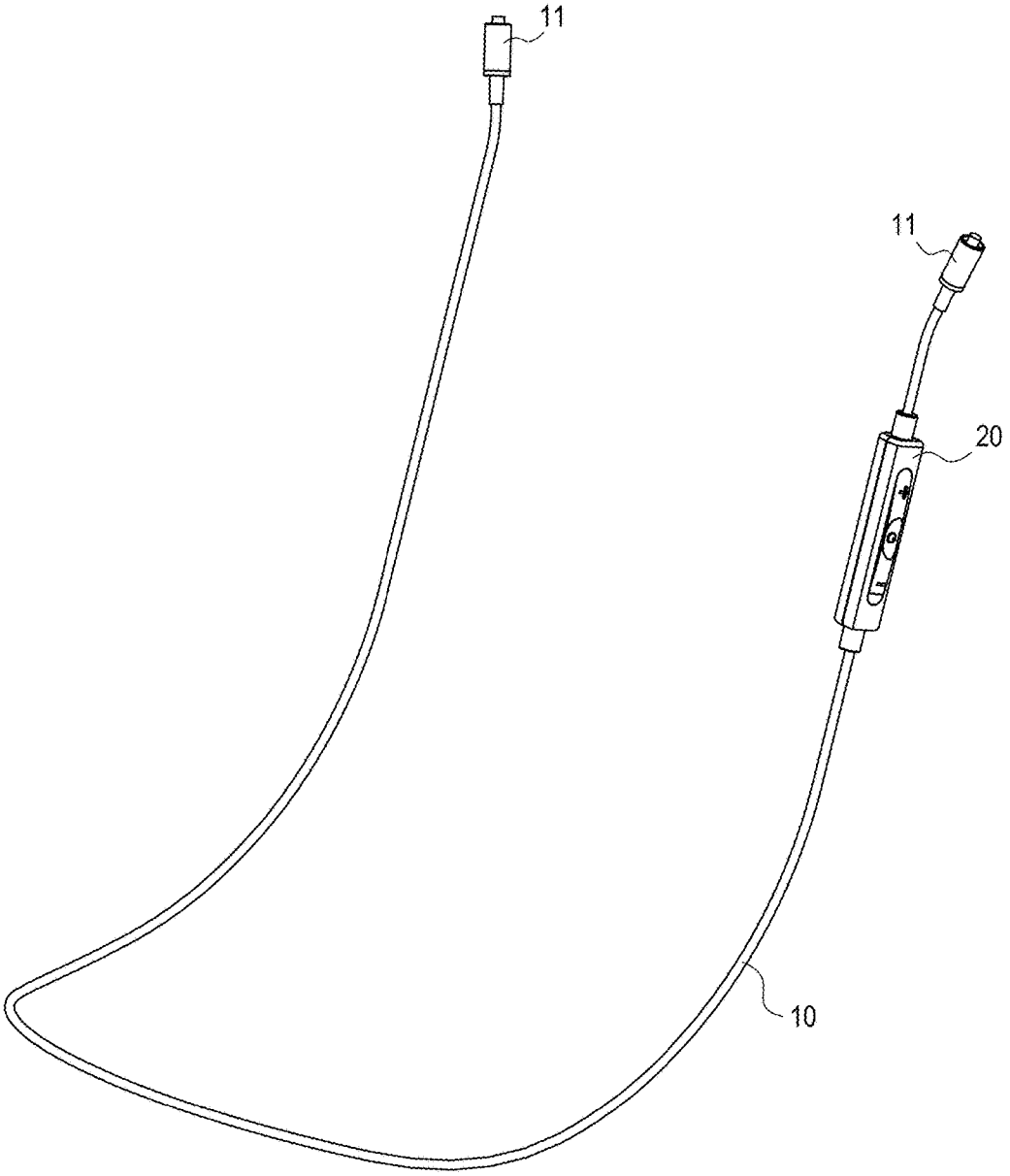
FIG. 3 is a perspective view of a second structure of the present invention.
Figure 4:
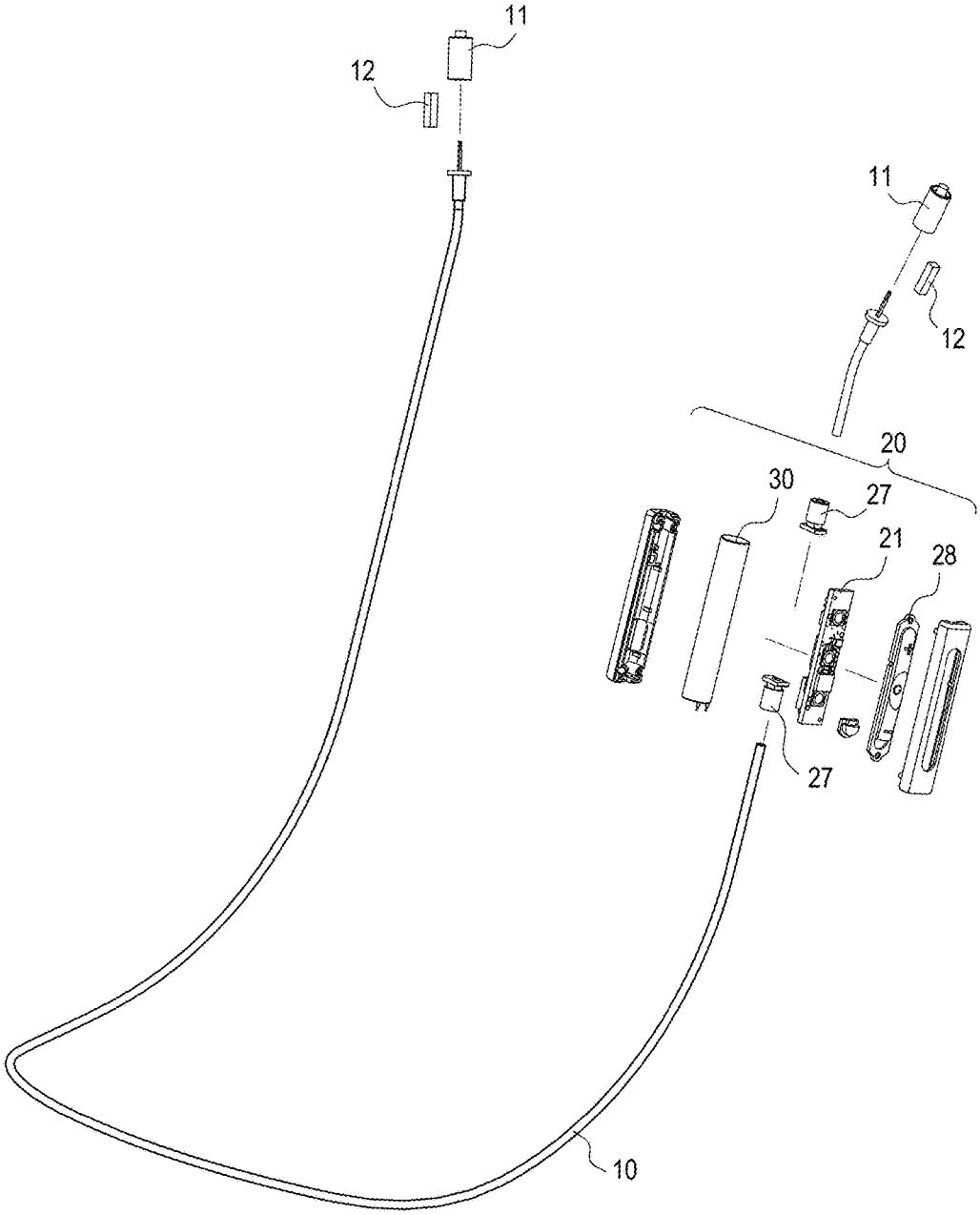
FIG. 4 is an exploded view of the second structure of the present invention.
Figure 5:
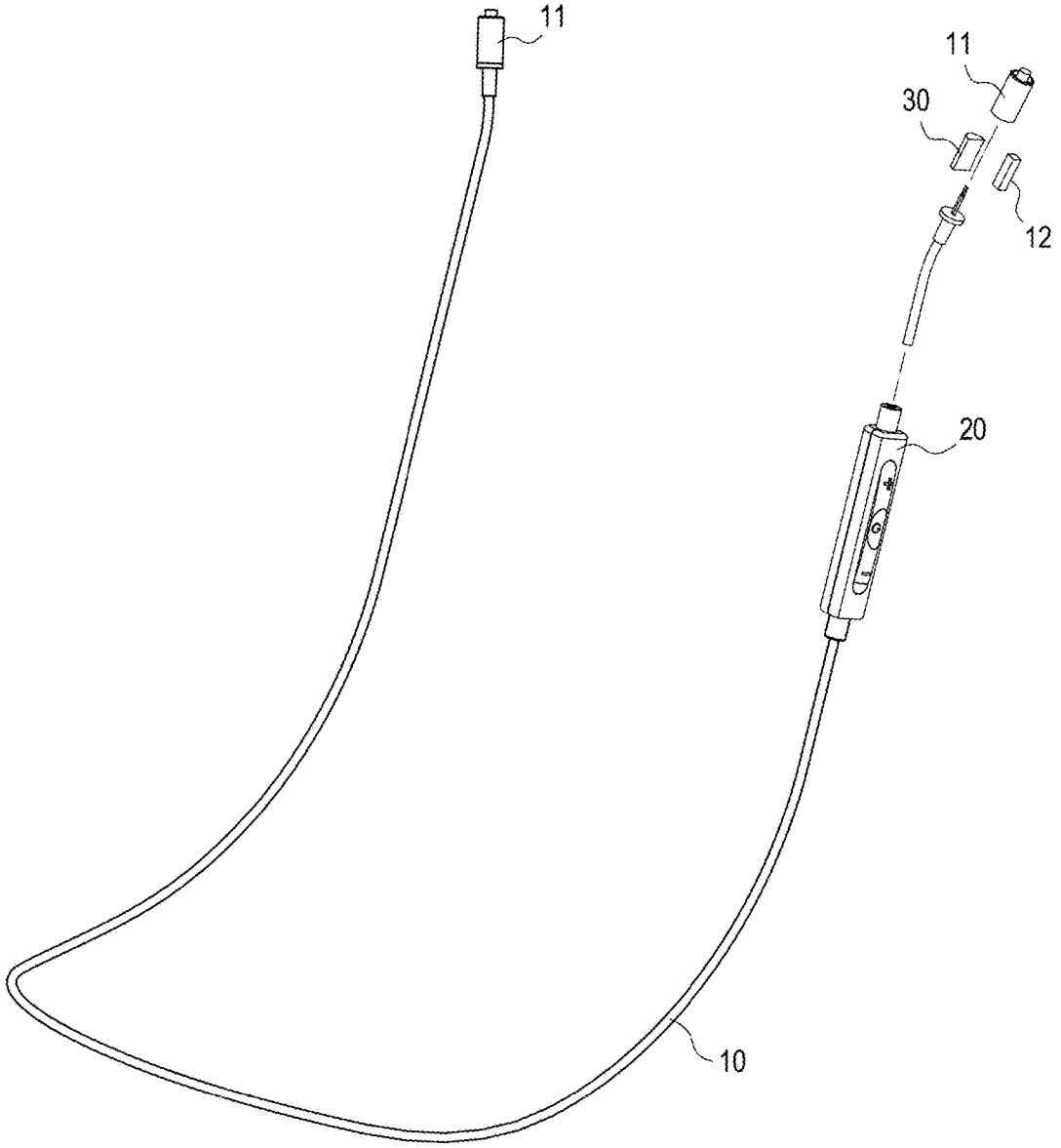
FIG. 5 is a partly exploded view of a third structure of the present invention.

Referring to FIGS. 3 and 4, in a preferred embodiment, the power supply unit 30 may be a battery installed in the controller 20 or in the audio connection portion 11 as FIG. 5 shows so as to improve appearance and operation.

The components and compositions of the present invention are described as above. Next, the use examples, features and benefits of the present invention will be described thereinafter.

Figure 6:
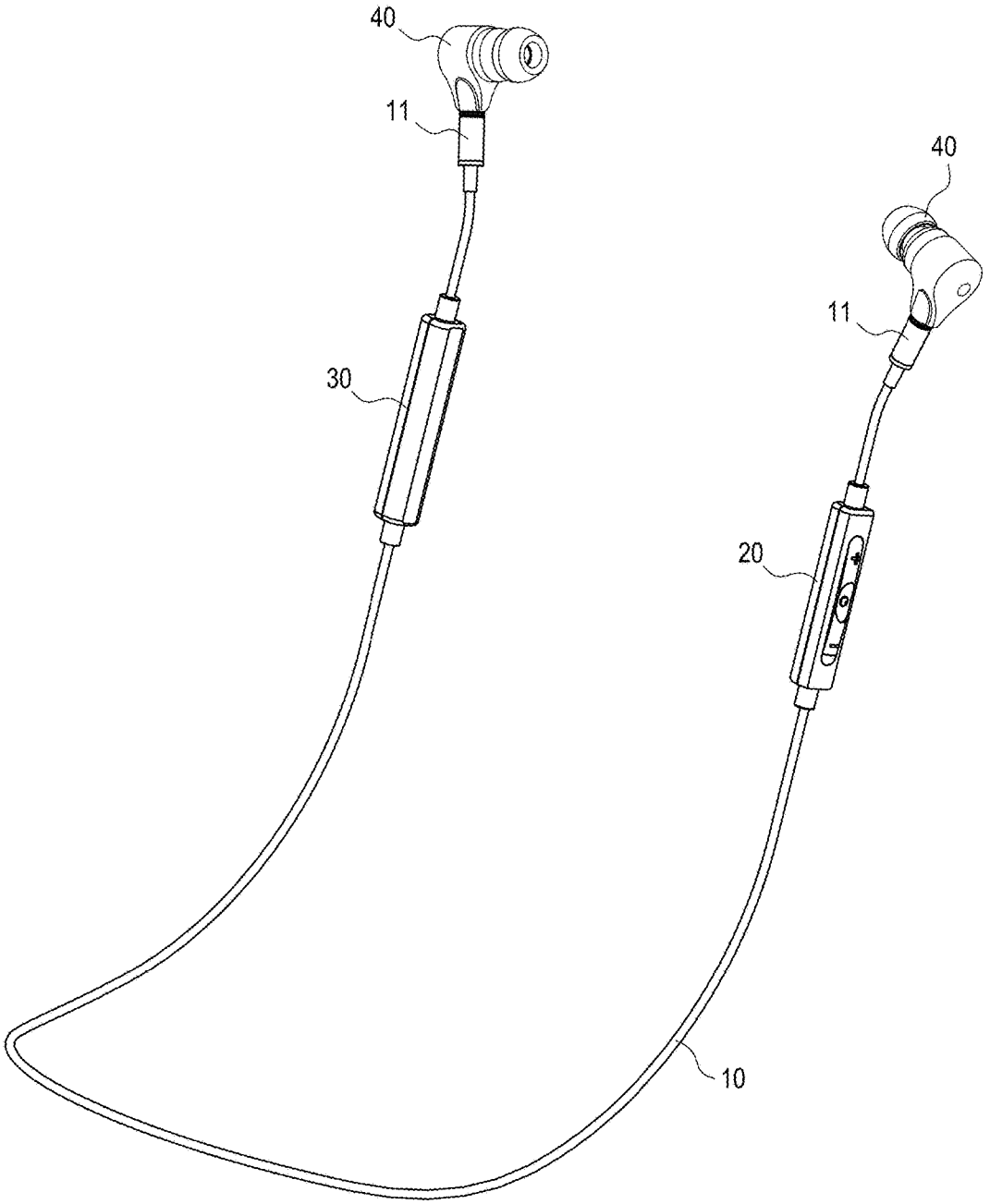
FIGS. 6 and 7 respectively are an exemplarily perspective view of the present invention in combination with a headphone.

Referring to FIG. 6, the present invention can be detachably coupled to an ear canal type headphone 40 through the audio connection portion 11.

Figure 7:
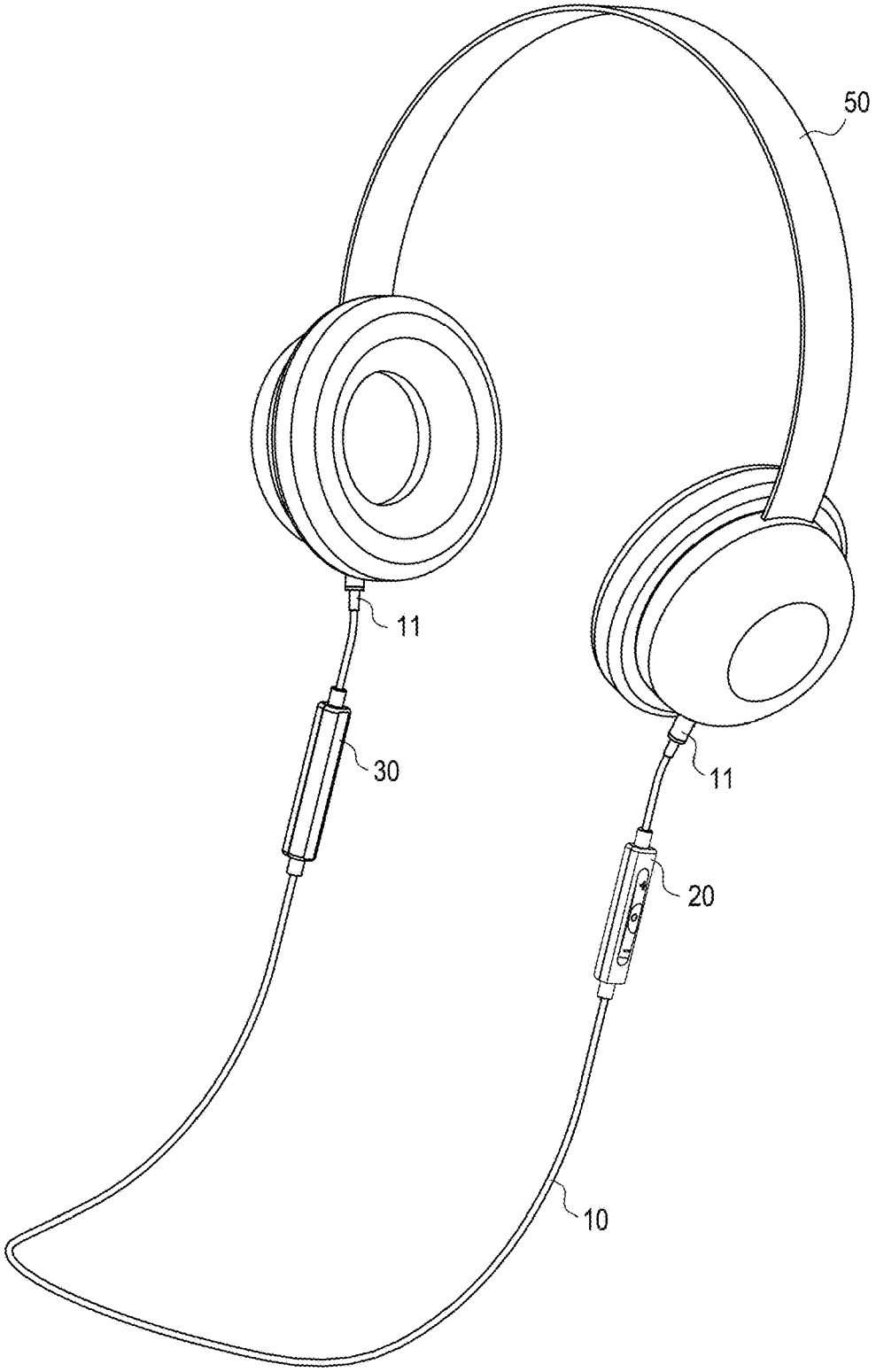

Referring to FIG. 7, the present invention may be detachably coupled to a circumaural headphone 50 through the audio connection portions 11.

Figure 8:
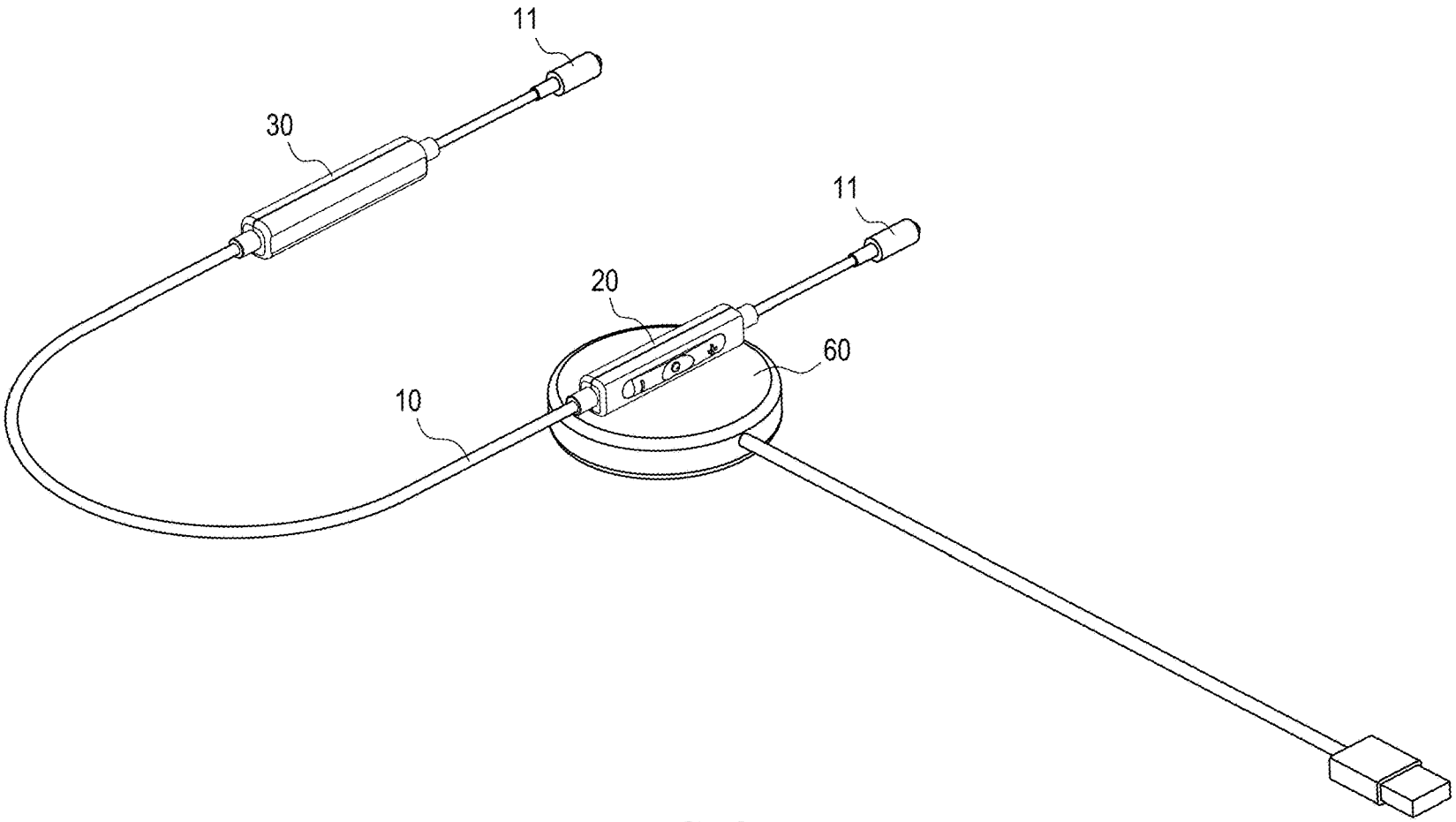
FIG. 8 is an exemplarily perspective view of the present invention and a wireless charger in a use state.
Figure 9:
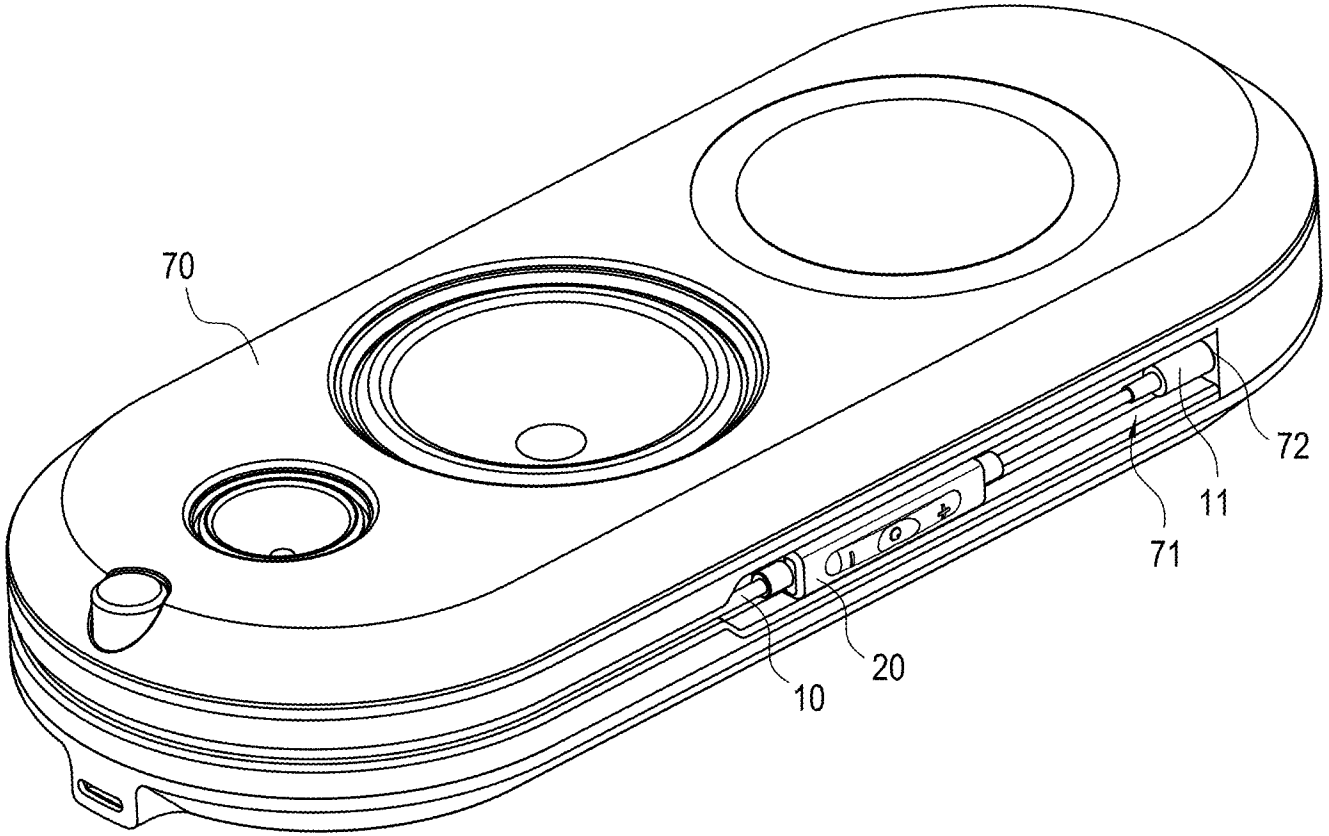
FIG. 9 is a perspective view of the present invention in combination with a speaker base.
Figure 10:
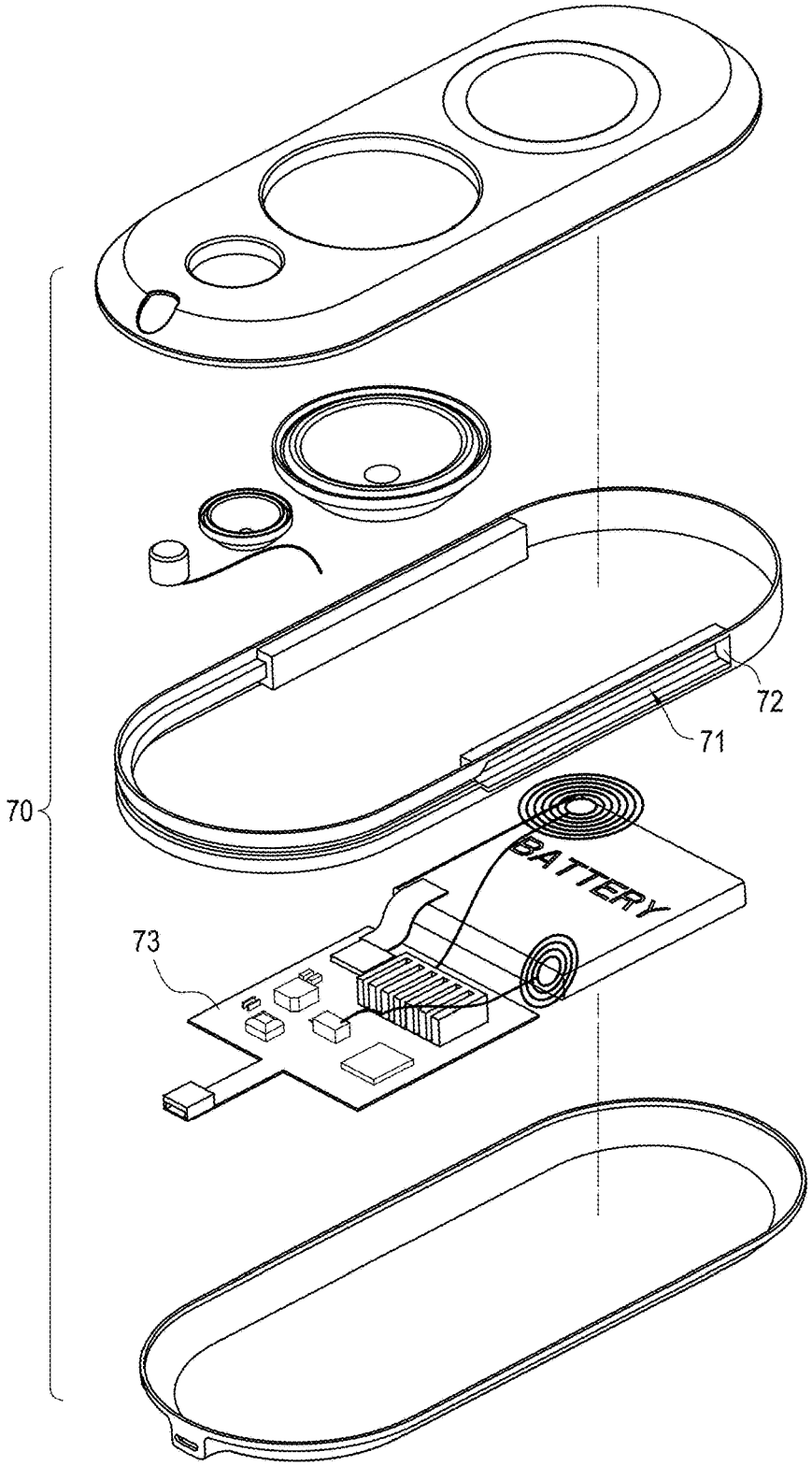
FIG. 10 is an exploded view of a speaker base.
Figure 11:
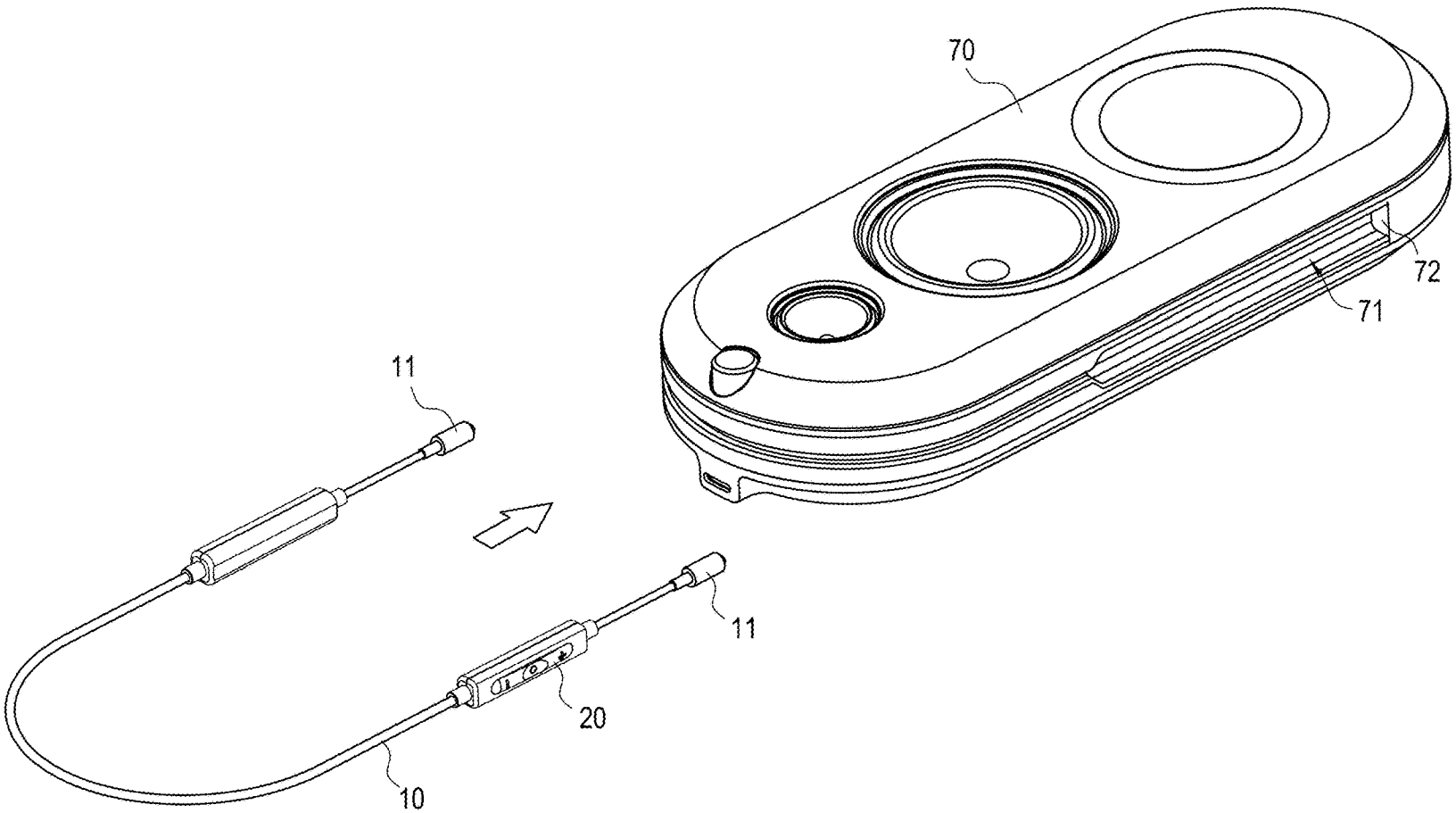
FIG. 11 is a schematically perspective view of the present invention in combination with a speaker base.
Figure 12:
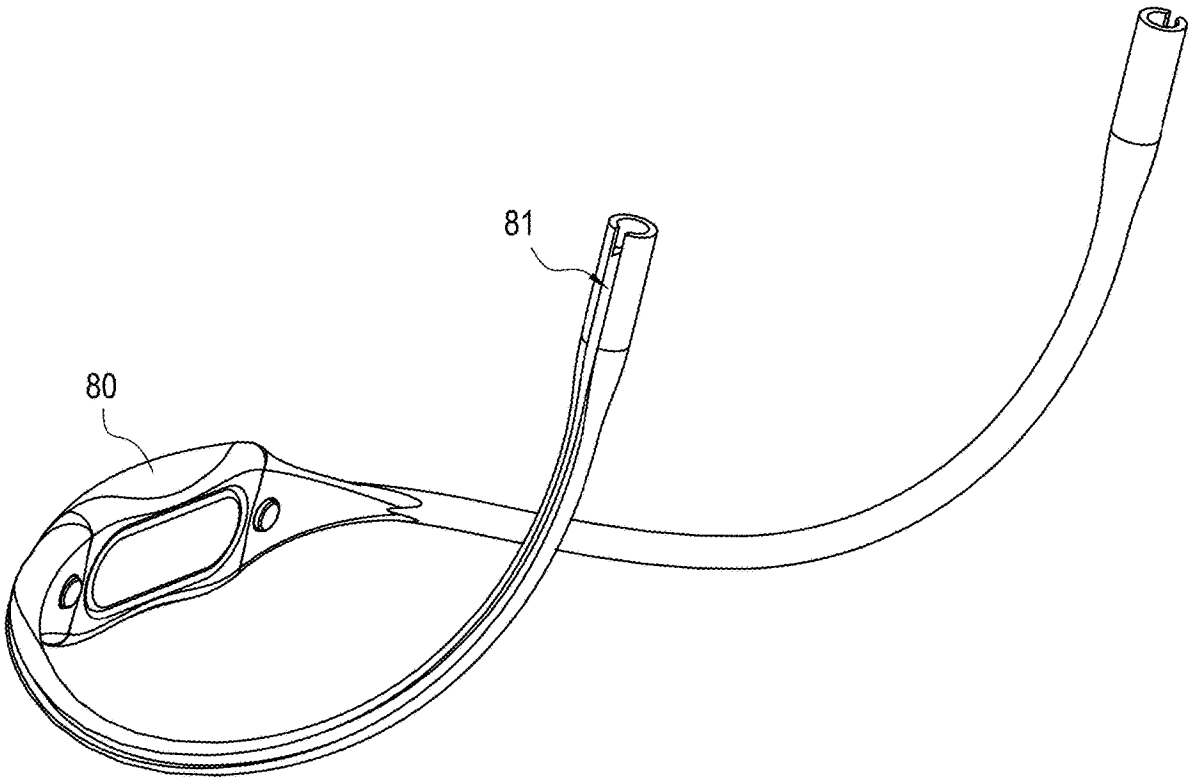
FIG. 12 is a perspective view of a wisdom collar.
Figure 13:
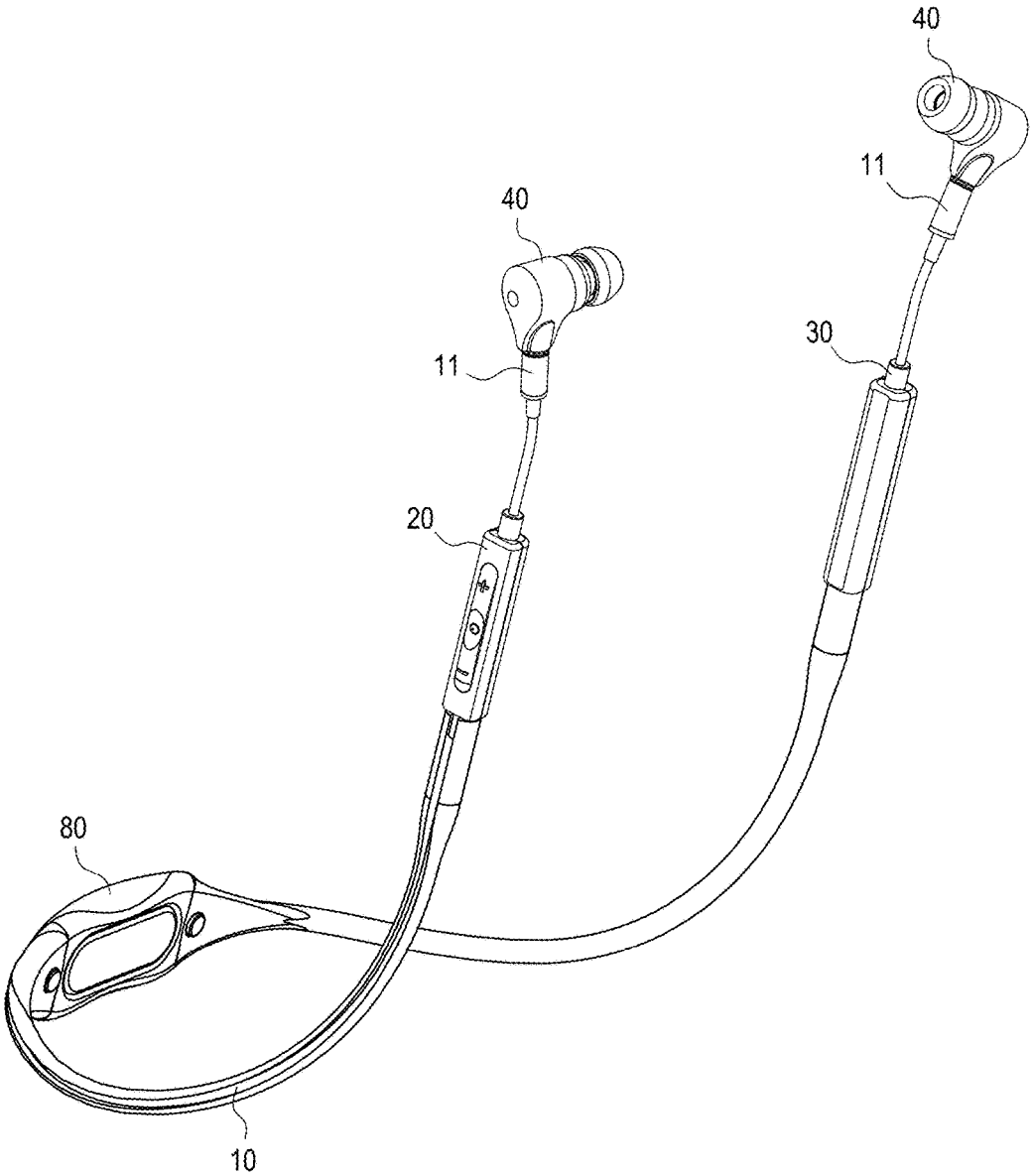
FIG. 13 is a perspective view of the present invention in combination with the wisdom collar.
Figure 14:
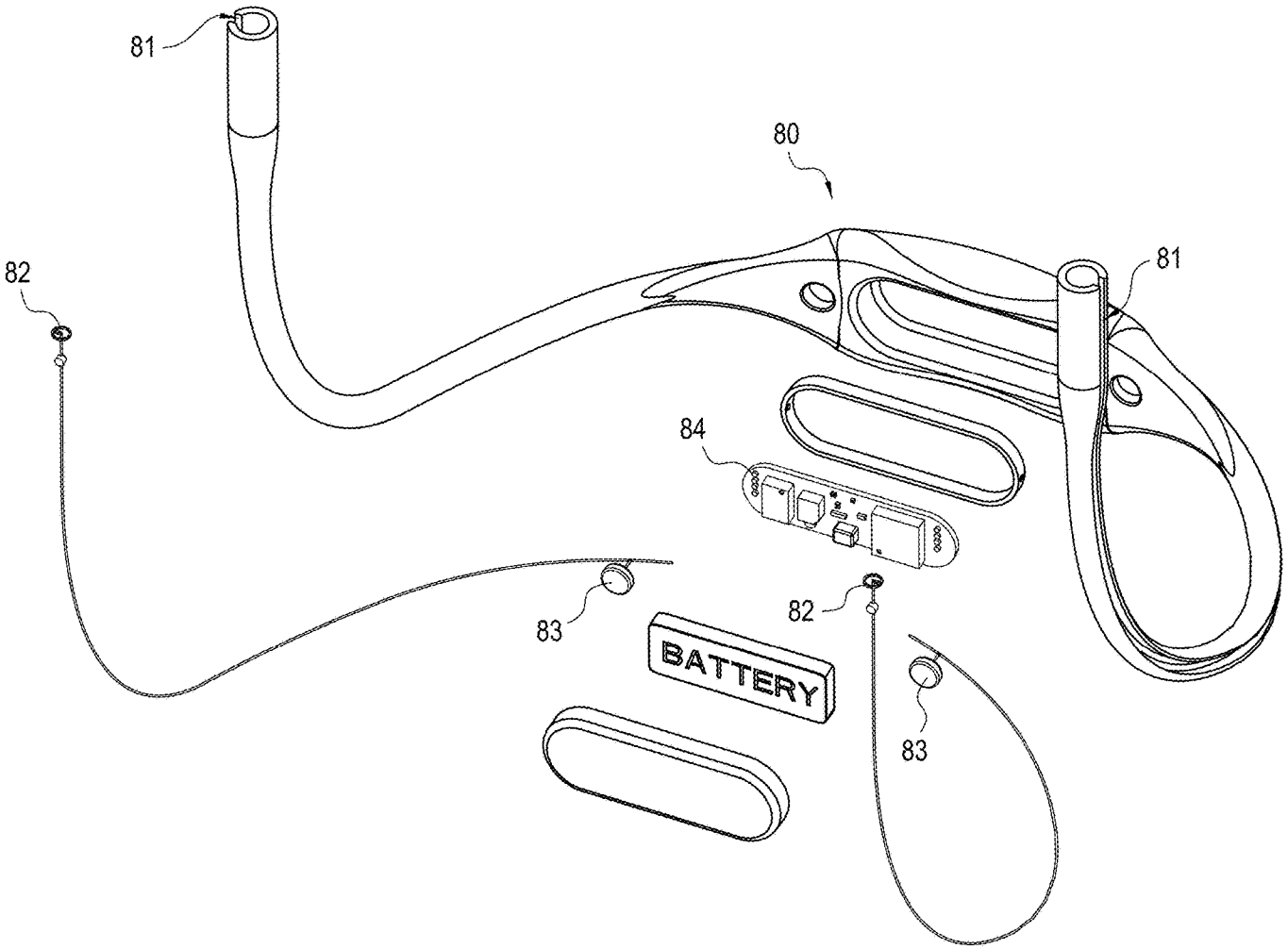
FIG. 14 is an exploded view of the wisdom collar.

Referring to FIG. 8, a wireless charger 60 matching with the present invention may be directly near to controller 20, and the wireless charging module 26 of the controller 20 generates electricity correspondingly by means of magnetic conduction effect, thereby charging the present invention.

The present invention thus has the following benefits:

1. a general wired headphone can be changed into a wireless active anti-noise headphone through the active noise cancelling module 22.

2. a general wired headphone can be changed into auxiliary hearing, hearing aid equipment through the hearing amplifier 23 and ANC module 22.

3. multimedia files such as music files can be stored in the memory module 24, and the wireless communication module can synchronize a smart device (e.g. cellular phone) or store multimedia files on a host and memorize playlists, and the present invention can still be used as a player to play music independently while the cellular phone or host is offline.

4. waterproof performance can be enhanced through the configuration of the wireless charging module 25 without needing a charger opening such as USB.

5. the wireless communication module 25 may be of various wireless technologies.

Referring to FIGS. 9, 10, 11 and 16, the present invention can be in combination with a speaker base 70 matching therewith, the outside of which is configured with an installation slot 71, the two sides of which are respectively configured with an audio connection port 72 so as to allow the present invention to be in engagement with the installation slot 71, and the audio connection portions 11 to be in combination with the respective audio connection ports 72 for audio transmission.

Inside the speaker base 70 is configured with a circuit board 73, which is in combination with a mobile power module and wireless inductive charging module.

Accordingly, the benefits can be generated as the following:

1. the speaker base 70 can be changed into a wireless speaker when in combination with the present invention.
2. the speaker base 70 itself is a wireless charging base, capable of the charging of the present invention.
3. the speaker base 70 itself can also be a mobile power supply, capable of the charging of a smart device such as smart phone.

Referring to FIGS. 12, 13, 14 and 17, the present invention can be in combination with a wisdom collar 80, on the outside of which is configured with an engagement groove 81, inside which is configured with two inductive coils 82 each in combination with a human body sensor 83 on a circuit board 84 including a charging coil adapted to correspond to the wireless charging module 26 of the present invention when the present invention is in engagement with the engagement grooves 81.

Accordingly, the benefits can thus be generated as the following:

1. the wisdom collar 80 can be changed into a wisdom wear collar when in combination with the present invention, capable of detecting an important human index such as heart rate or calories, and connected to a smart device such as smart phone.
2. The wisdom collar 80 can be used as a wireless charging base for the charging of the present invention.

We claim:

1. A multifunctional headphone cable, comprising:

a connecting line, wherein two ends thereof respectively having an audio connection portion configured with a noise receiving microphone;

a controller, configured on said connecting line, wherein the controller comprises a control circuit, a memory module, a wireless communication module and a wireless charging module, said control circuit is configured with an active noise cancelling (ANC) module in connection with said noise receiving microphone, said control circuit is further configured with a hearing amplifier adapted to amplify audio signals; and a power supply unit, configured in said controller or audio connection portion; wherein a speaker base is in communication with said multifunctional headphone cable, an installation slot is configured on an outside of said speaker base, two sides of said installation slot are respectively configured with an audio connection port, said multifunctional headphone cable is in engagement with said installation slot, and said audio connection portions are electrically connected to said respective audio connection ports; and a circuit board is configured inside said speaker base, and said circuit board is in combination with a mobile power module and a wireless inductive charging module.

2. The multifunctional headphone cable according to claim 1, wherein first shell joints on two ends of said controller are respectively configured with a waterproof body, and second shell joints of two sides of said power supply unit are respectively configured with a sealing body, and said both being used for waterproof seal.

3. The multifunctional headphone cable according to claim 1, wherein said controller comprises a control interface in connection with said control circuit.

4. The multifunctional headphone cable according to claim 1, wherein said control circuit is configured with a lamp, and a lampshade is configured on an outside thereof.

5. The multifunctional headphone cable according to claim 1, wherein said wireless communication module is selected from the group consisting of Wi-Fi, 4G, 5G, Bluetooth, radio frequency (RF) or near field communication (NFC).

6. The multifunctional headphone cable according to claim 1, wherein said wireless charging module is a wireless charging coil.

7. The multifunctional headphone cable according to claim 1, wherein said power supply unit is a battery.

8. The multifunctional headphone cable according to claim 1, wherein a wisdom collar is in combination therewith, an engagement groove is configured on an outside of said wisdom collar, two inductive coils are configured on said engagement groove, each said inductive coil is in combination with a human body sensor on a circuit board comprising a charging coil, said multifunctional headphone cable is engaged with said engagement groove, and said wireless charging module cooperates with said inductive coil for wireless charging.

* * * * *